United States Patent [19]

Bauer

[11] 4,262,179

[45] Apr. 14, 1981

[54] CONTACT BRIDGE ARRANGEMENT

[75] Inventor: Johann Bauer, Ebermannstadt, Fed. Rep. of Germany

[73] Assignee: Siemens Aktiengesellschaft, Berlin and Munich, Fed. Rep. of Germany

[21] Appl. No.: 55,363

[22] Filed: Jul. 6, 1979

[30] Foreign Application Priority Data

Jul. 31, 1978 [DE] Fed. Rep. of Germany ..... 2833537

[51] Int. Cl.[3] ..... H01H 5/06

[52] U.S. Cl. ..... 200/153 SC; 200/154; 200/243; 200/322

[58] Field of Search ..... 200/153 SC, 153 J, 154, 200/243, 160, 67 A, 307, 321, 322, 245, 16 C, 16 A

[56] References Cited

U.S. PATENT DOCUMENTS 3,436,497 4/1969 Mading ..... 200/243

4,002,874 1/1977 Brown ..... 200/321

4,029,924 6/1977 Frank et al. ..... 200/307

*Primary Examiner*—Willis Little

*Attorney, Agent, or Firm*—Kenyon & Kenyon

[57] ABSTRACT

A contact bridge arrangement useful particularly in electromagnetic switchgear has a set of fixed contacts and a contact bridge which can be brought into active connection therewith. The contact bridge is movably guided in a window of a contact bridge carrier being spring loaded in the direction of the fixed contacts by a spring which is braced on a support part which is carried, in the active position, on parts fixed to the housing and which is elevated by a stop in the window of the contact bridge carrier. The support part is inserted between a spring cup and the stop in the window of the contact bridge carrier from the outside of the contact bridge assembly in a direction transverse to the direction of the spring loading.

7 Claims, 6 Drawing Figures

CONTACT BRIDGE ARRANGEMENT

BACKGROUND OF THE INVENTION

1. Field of the Invention

This invention relates to a contact bridge assembly for use, in particular, with electromagnetic switch gear having fixed contacts and having a contact bridge which can be brought into functional connection with the fixed contacts. The contact bridge is movably guided in a window of a contact bridge carrier, spring-biased in the direction of the fixed contacts by a spring braced by a support part which is supported, in its active position, by parts fixed to the housing and which is lifted by a stop in the window of the contact bridge carrier.

2. Description of the Prior Art

In one known contact bridge arrangement of the abovementioned type (German Auslegeschrift No. 1 300 611) it is necessary, in order to bring the support part into engagement with the parts fastened to the housing, to use a housing which is divided into two parts or to design the fixed contacts in a U-shape in such a manner that they come into connection the support part through a U-leg. With these known arrangements, a considerable amount of effort must be spent in assembling the equipment.

SUMMARY OF THE INVENTION

The present invention provides an arrangement of the above-mentioned type which is suitable for automated assembly and is of simple design. This is achieved by making the support part a slider which can be inserted from the outside of the contact bridge structure between a spring cup and the stop in the window of the contact bridge carrier and transversely to the direction of the spring load. The spring cup and the stop in the window are separated automatically by this action since the stop and the slider have inclined run-on slopes. Automatic lifting of the spring cup and cocking of the spring, as well as prevention of incorrect insertion of the slider are ensured by arranging for the surfaces of the parts fixed to the housing to be elevated successively, in the direction of insertion, and by providing the slider with a compensating extension having a height which corresponds to the difference in elevation. The insertion process is further simplified by also providing inclined run-on surfaces on the part fixed to the housing which the slides encounters first in the direction of insertion, as well as for the compensation extension.

DETAILED DESCRIPTION OF THE INVENTION

Figure 1:
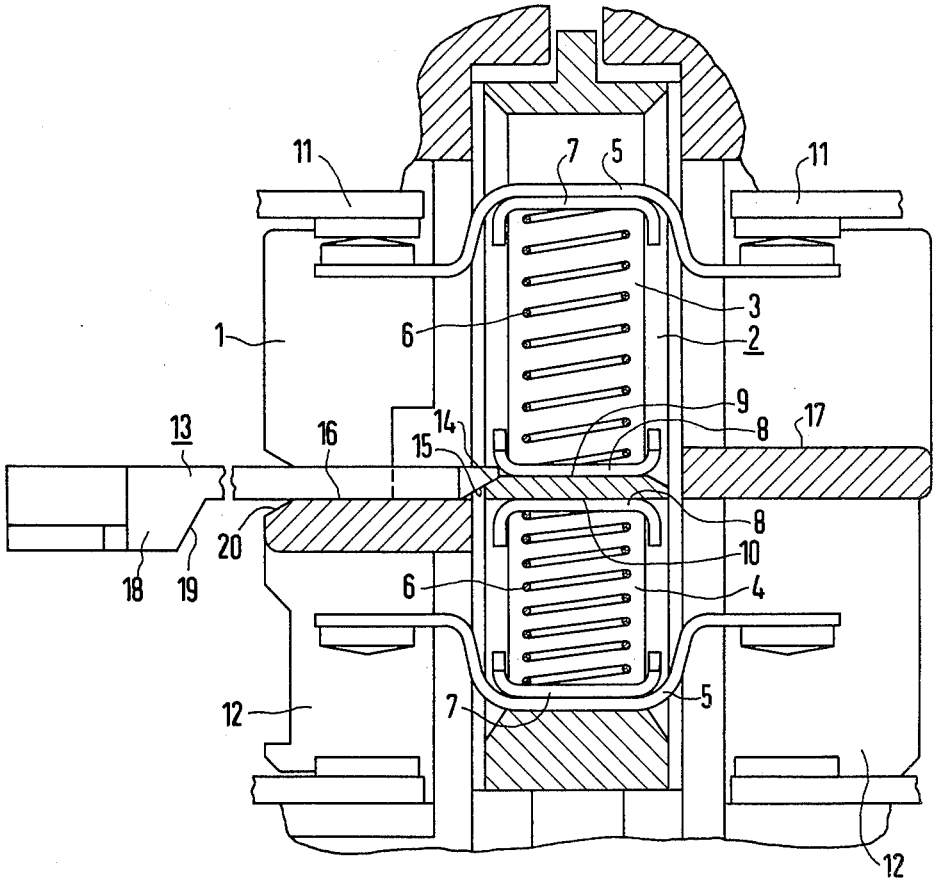
FIG. 1 is a view in cross-section, in the region of the support part, through a switching apparatus having two contact bridges and associated fixed contacts, with the slider not yet inserted.
Figure 2:
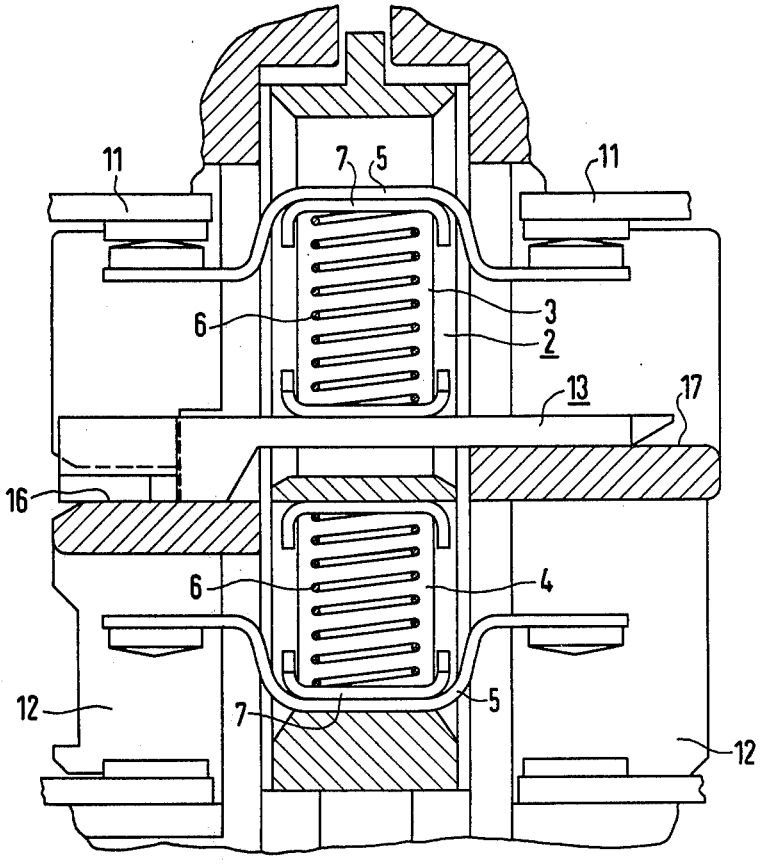
FIG. 2 is a view like that of FIG. 1, with the slider inserted.

The switching equipment contact bridge assembly shown in the drawing consists of a contact bridge carrier 2 which is movably guided in a housing 1 and is provided with windows 3 and 4, in which contact bridges 5 are guided movably against the force of springs 6. Springs 6 are braced by spring cups 7 against contact bridges 5 on their outer ends and rest in spring cups 8 against stops surfaces 9 and 10 of windows 3 and 4, respectively. Contact bridge 5, on top in FIG. 1, cooperates, as a "break" contact, with fixed contacts 11, and the contact bridge 5 which is movably guided in lower window 4, cooperates with fixed contacts 12 as a "make" contact. In order to substantially reduce the power required and to provide a uniform force distribution when contact bridge carrier 2 moves across the entire switching path, a so-called break-contact support is provided, which consists of a slider 13 which is pushed between stop 9 in contact bridge window 4 and upper spring cup 8. In FIG. 1 the slider is shown in preliminary contact with spring cup 8; in FIG. 2, it is inserted in the operating position. In order to facilitate the insertion, sloping surfaces 14 and 15 are provided on stop 9 and on slider 13, respectively. The parts 16 and 17 against which slider 13 is braced in its inserted position, are fixed to the housing and are arranged in step-fashion, rising in the direction of insertion, with the support surface on part 16, to the left in the drawing, being lower than that on part 17, at the right. The change in elevation (rise) is provided so that, after spring cup 8 has been lifted off stop 9 and the thickness of slider 13 has penetrated between the two parts guided by sloping surface 15, the slider rests, closely fitted, against support part 17, slider 13 being elevated further thereby. Compensating extension 18 on slider 13 is then supported on part 16. For easier insertion, another set of inclined surfaces 19 and 20 is provided on slider 13 and on housing part 16, respectively.

Figure 3:
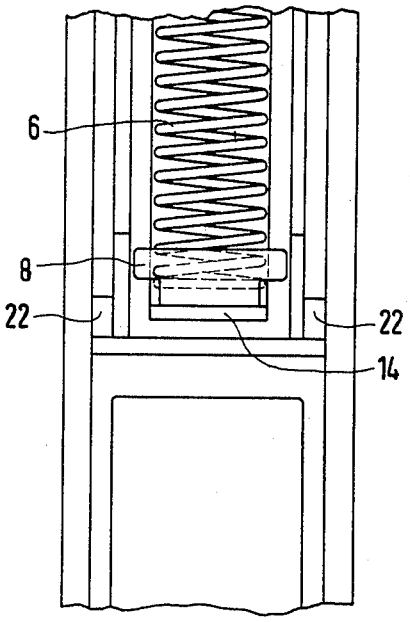
FIG. 3 is a view in cross-section taken at an angle 90° away, through the equipment of FIG. 1 in the vicinity of the slider.
Figure 4:
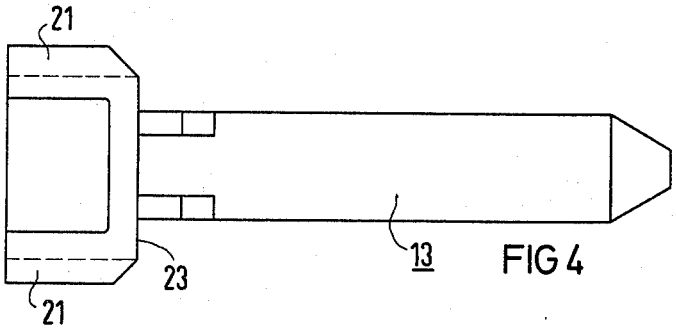
FIGS. 4, 5 and 6 show a top view, a side view, and a front view, respectively, of a slider in accordance with the teachings of the invention.
Figure 5:
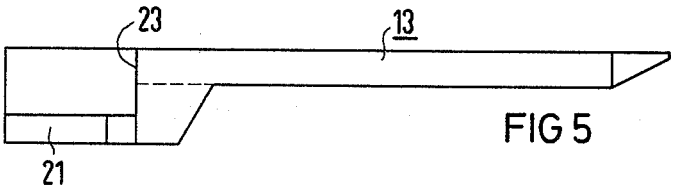
Figure 6:
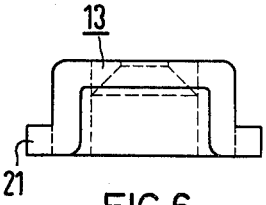

Detail of slider 13 can be seen in FIGS. 4 to 6, to which reference is now made. Slider 13 has extensions 21, in the vicinity of compensating extension 18, which engage in slot-like recesses 22 in housing 1 when slider 13 is in the inserted condition (best seen in FIG. 3.). The extensions 21 are asymmetrically arranged in such a way that the slider can be inserted only in the position shown in the drawing. A stop surface 23 limits insertion movement of slider 13.

The slider of the invention thus provides a break-contact support which allows a relatively high pre-tension of the springs to be attained in a simple manner without the need to move the contact bridge carrier into an extreme position or to remove parts 16 and 17, fixed to the housing, or of having to work with a divided housing. The arrangement according to the invention is particularly well suited for automatic assembly. In addition, the slider can be inserted only in one position, which prevents incorrect insertion.

What is claimed is:

1. In a contact bridge arrangement comprising fixed contacts, a contact bridge which is movably guided into contact therewith in a window of a contact bridge carrier, a spring biasing the contact bridge for motion towards the fixed contacts, and a support part on which the spring is braced in the active position, the support part in turn supported on parts fixed to a housing and elevated by a stop in the window of the contact bridge carrier, the improvement comprising:

the support part being a slider which is inserted from the outside of the contact bridge arrangement, between a cup surrounding the end of the spring and a stop on the contact bridge window, in a direction transverse to the direction of the spring loading.

2. In a contact spring arrangement according to claim 1, the further improvement comprising:

the stop and the slider having sloping run-on surfaces.

3. In a contact spring arrangement according to claim 1 or claim 2 the further improvement comprising:

the parts fixed to the housing being stepped upwards in the direction of insertion and the slider being provided with a compensating extension, corresponding in height to the difference in elevation of the steps.

4. In a contact spring arrangement in accordance with claim 3, the further improvement comprising:

the part fixed to the housing which is first encountered by the slider during insertion and the compensating extension both having sloping run-on surfaces.

5. In a contact spring arrangement in accordance with one of the claims 1 and 2, the further improvement comprising:

the slider having extensions for engaging recesses in the housing to insure insertion of the slider, secure against rotation.

6. In a contact spring arrangement in accordance with claim 3, the further improvement comprising:

the slider having extensions for engaging recesses in the housing to insure insertion of the slider, secure against rotation.

7. In a contact spring arrangement in accordance with claim 4, the further improvement comprising:

the slider having extensions for engaging recesses in the housing to insure insertion of the slider, secure against rotation.

* * * * *